US008768225B2

(12) United States Patent
Oba et al.

(10) Patent No.: US 8,768,225 B2
(45) Date of Patent: Jul. 1, 2014

(54) IMAGE FORMING APPARATUS HAVING A DEVELOPER HOLDER WITH A CONCAVO-CONVEX OUTER SURFACE

(75) Inventors: Shota Oba, Kanagawa (JP); Takashi Ochi, Kanagawa (JP); Shigeru Inaba, Kanagawa (JP); Yoshitaka Nakajima, Kanagawa (JP); Akihisa Maruyama, Kanagawa (JP); Toshihiro Kanematsu, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 278 days.

(21) Appl. No.: 13/273,800

(22) Filed: Oct. 14, 2011

(65) Prior Publication Data

US 2012/0251189 A1 Oct. 4, 2012

(30) Foreign Application Priority Data

Mar. 28, 2011 (JP) ..... 2011-070955

(51) Int. Cl.
*G03G 15/08* (2006.01)

(52) U.S. Cl.
USPC ..... 399/270

(58) Field of Classification Search
USPC ..... 399/270
See application file for complete search history.

(56) References Cited

U.S. PATENT DOCUMENTS

| | | | | |
|---|---|---|---|---|
| 5,879,849 | A * | 3/1999 | Sawada et al. | 430/108.7 |
| 2009/0110445 | A1 | 4/2009 | Yamada | |
| 2009/0214271 | A1 * | 8/2009 | Yamada et al. | 399/284 |

FOREIGN PATENT DOCUMENTS

| | | | |
|---|---|---|---|
| JP | A-2005-173141 | | 6/2005 |
| JP | 2006301165 | A * | 11/2006 |
| JP | A-2010-2927 | | 1/2010 |
| JP | A-2010-197948 | | 9/2010 |
| JP | 2011069898 | A * | 4/2011 |

* cited by examiner

*Primary Examiner* — Quana M Grainger
(74) *Attorney, Agent, or Firm* — Oliff PLC

(57) ABSTRACT

An image forming apparatus includes a rotating image carrier, a charging device, a latent image forming device, a developing device having a developer holder and developing a latent image as a visible image, a voltage application unit that generates a potential difference between the image carrier and the developer holder to form an electric field, by which toner is directed toward the latent image, in a developing region, and a transfer device that transfers the visible image of the image carrier to a medium, wherein the developer holder having a concavo-convex portion having a convex portion and a concave portion is provided in an outer surface thereof and formed such that the volume resistivity of a portion corresponding to the convex portion is set to be larger than the volume resistivity of a portion corresponding to the concave portion.

6 Claims, 12 Drawing Sheets

IMAGE FORMING APPARATUS HAVING A DEVELOPER HOLDER WITH A CONCAVO-CONVEX OUTER SURFACE

CROSS-REFERENCE TO RELATED APPLICATIONS

This application is based on and claims priority under 35 USC 119 from Japanese Patent Application No. 2011-070955 filed Mar. 28, 2011.

BACKGROUND

Technical Field

The present invention relates to an image forming apparatus.

SUMMARY

According to an aspect of the invention, there is provided an image forming apparatus including: a rotating image carrier; a charging device that charges an outer surface of the image carrier; a latent image forming device that forms a latent image on the outer surface of the charged image carrier; a developing device that has a developer container that stores a developer including a toner and a carrier, and a developer holder that holds the developer stored in the developer container on the outer surface and rotates and transports the developer toward a developing region that faces the image carrier, and that develops the latent image of the image carrier as a visible image; a voltage application unit that applies a voltage to the developer holder, and that generates a potential difference between the image carrier and the developer holder to form an electric field, by which a toner is directed toward the latent image of the image carrier from the developer holder, in a developing region; and a transfer device that transfers the visible image of the image carrier to a medium, wherein the developer holder having a concavo-convex portion having a convex portion and a concave portion is provided in an outer surface thereof and formed such that the volume resistivity of a portion corresponding to the convex portion is set to be larger than the volume resistivity of a portion corresponding to the concave portion.

BRIEF DESCRIPTION OF THE DRAWINGS

Exemplary embodiments of the present invention will be described in detail based on the following figures, wherein:

FIG. 5A is an explanatory view of chief parts of the outer surface of the developing sleeve, and FIG. 5B is a cross-sectional view of chief parts of the developing sleeve;

DETAILED DESCRIPTION

Figure 1:
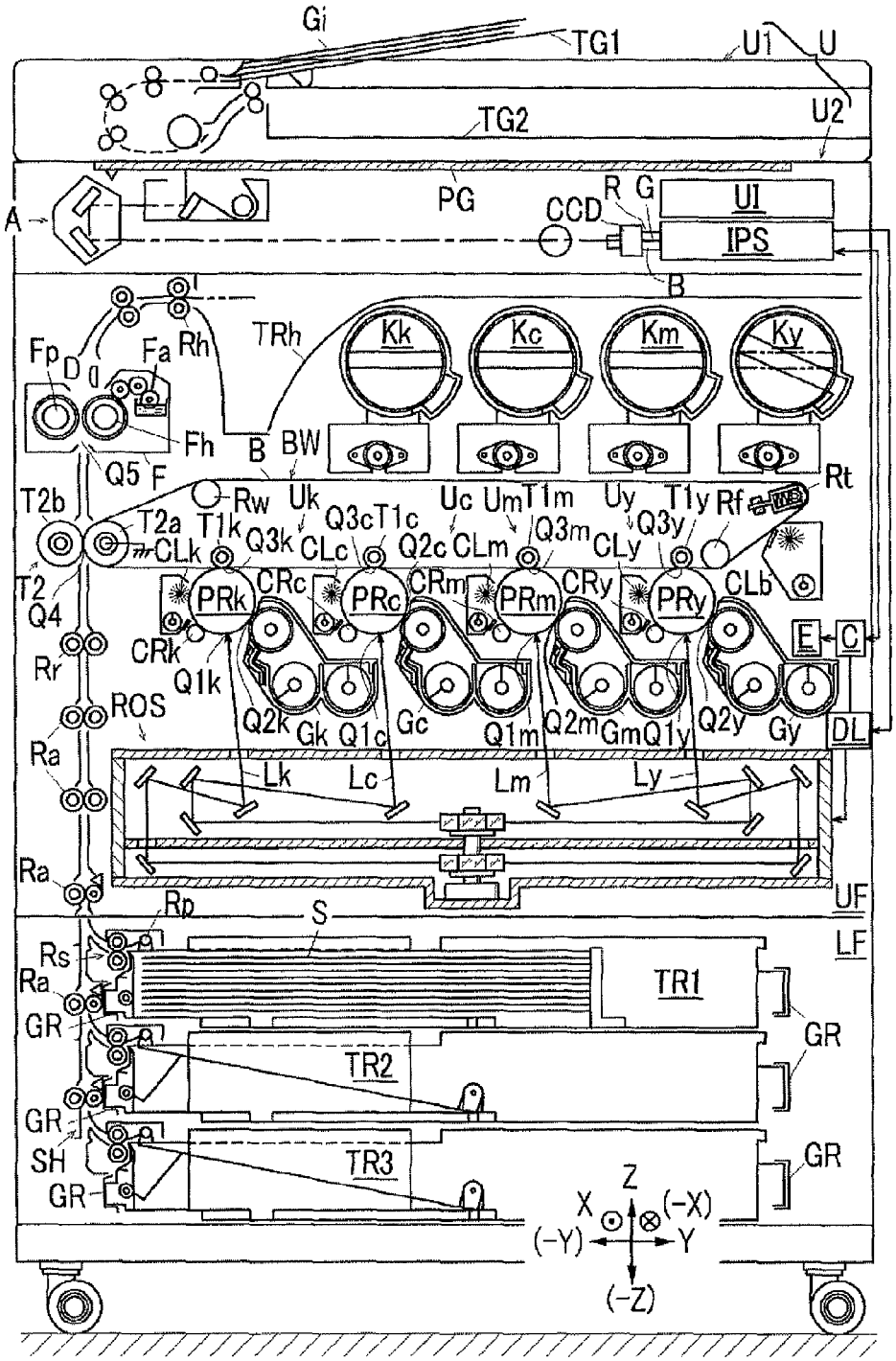
FIG. 1 is a front cross-sectional view of an image forming apparatus of Example 1 of the invention.

Next, although specific examples (hereinafter referred to as Examples) of an exemplary embodiment of the invention will be described referring to the drawings, the invention is not limited to the following Examples.

In addition, in order to make the invention more easily understood, in the drawings, the front-and-rear direction is defined as an X-axis direction, the right-and-left direction is defined as a Y-axis direction, and the up-and-down direction is defined as a Z-axis direction.

Additionally, directions or sides shown by arrows X, −X, Y, −Y, Z, and −Z are defined as a front direction, a rear direction, a right direction, a left direction, an up direction, and a down direction, respectively, or are defined as front side, rear side, right side, left side, upper side, and lower side, respectively.

Additionally, in the drawings, a symbol in which "." is described in "O" means an arrow that faces the front of a sheet from the back thereof, and a symbol in which "X" is described in "O" means an arrow that faces the back of the sheet from the front thereof.

In addition, in the following description using the drawings, illustration of those other than members required for description are appropriately omitted for easy understanding.

Example 1

FIG. 1 is a front cross-sectional view of an image forming apparatus of Example 1 of the invention.

In FIG. 1, a copying machine U as an example of the image forming apparatus of Example 1 of the invention includes an automatic document feeder U1, and an image forming apparatus body U2 that supports this document feeder and has a transparent document platen PG at the upper end thereof.

The automatic document feeder U1 has an document feed unit TG1 on which plural documents G1 to be copied are stacked and placed, and a document ejection unit TG2 to which a document G1 transported through a document reading position on the document platen PG from the document feed unit TG1 is ejected.

The image forming apparatus body U2 has an operation unit UI through which a user performs input operation of operation command signals, such as a copy start, an exposure optical system A, and the like.

The reflected light from a document transported on the document platen PG by the automatic document feeder U2 or an document manually placed on the document platen PG is converted into electrical signals of red R, green G, and blue B by a solid-state imaging device CCD via the exposure optical system A.

The image conversion unit IPS converts and temporarily stores electrical signals of RGB input from a solid-state imaging device CCD into image information of black K, yellow Y, magenta M, and cyan C, and outputs the image information to a latent image forming device drive circuit DL as image information for formation of a latent image at a preset timing.

In addition, when the image of a document is a unicolor image, so-called monochrome, image information of black K only is input to the latent image forming device drive circuit DL.

The latent image forming device drive circuit DL has respective latent image forming device drive circuits (not shown) of respective colors Y, M, C and K, and outputs latent image forming device driving signals according to input image information to latent image writing light irradiation units (not shown) for respective colors of a latent image forming device ROS at a preset timing.

Figure 2:
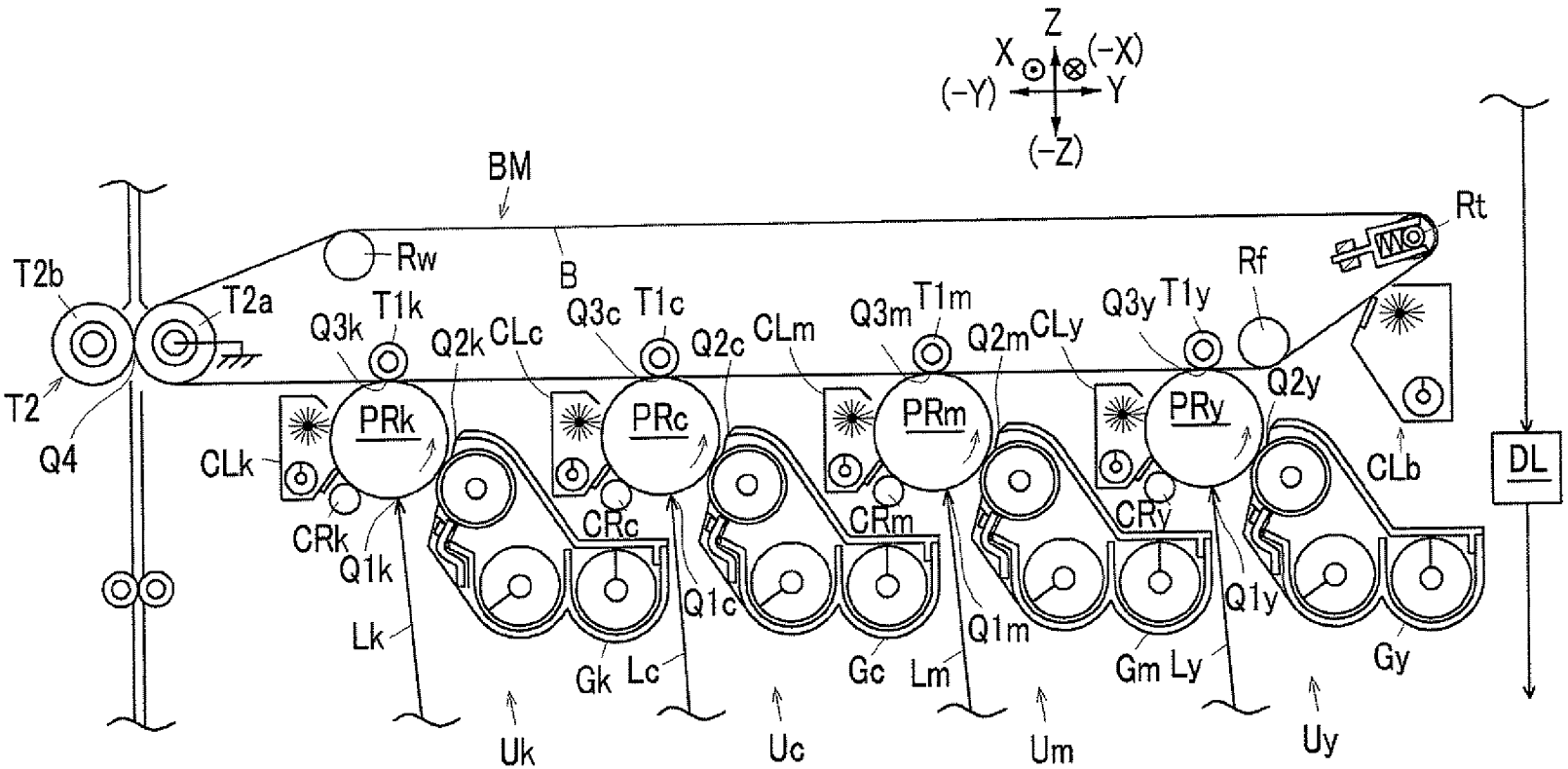
FIG. 2 is an enlarged view of chief parts of the image forming apparatus of Example 1 of the invention.

FIG. 2 is an enlarged view of chief parts of the image forming apparatus of Example 1 of the invention.

Visible image forming devices Uy, Um, Uc, and Uk arranged above the latent image forming device ROS, are devices that form toner images as an example of visible images of respective colors of yellow Y, magenta M, cyan C, and black K, respectively.

From respective latent image formation light irradiation units (not shown) of the latent image forming device ROS, laser beams Ly, Lm, Lc, and Lk of Y, M, C, and K, are irradiated as an example of latent image writing light. The laser beams Ly, Lm, Lc, and Lk enter rotating image carriers PRy, PRm, PRc, and PRk, respectively.

The visible image forming device Uy for Y color has an image carrier PRy, a charging roller CRy as an example of a charging device, a developing device Gy, and a primary transfer roller T1*y* as an example of a primary transfer device, and an image carrier cleaner CLy, and all the visual image forming devices Um, Uc, and Uk are configured similarly to the above visible image forming device Uy of Y color.

The respective image carriers PRy, PRm, PRc, and PRk are uniformly charged by the charging rollers CRy, CRm, CRc, and CRk, respectively, and then electrostatic latent images are formed on the surface of the image carriers by the laser beams Ly, Lm, Lc, and Lk at image writing positions Q1*y*, Q1*m*, Q1*c*, and Q1*k*. The electrostatic latent images of the outer surfaces of the image carriers PRy, PRm, PRc, and PRk are developed as toner images by the developing devices Gy, Gm, Gc, and Gk in developing regions Q2*y*, Q2*m*, Q2*c*, and Q2*k*.

The developed toner images are transported to primary transfer regions Q3*y*, Q3*m*, Q3*c*, and Q3*k* that come into contact with an intermediate transfer belt B as an example of an intermediate transfer body. In the primary transfer regions Q3*y*, Q3*m*, Q3*c*, and Q3*k*, primary transfer voltages with polarity opposite to the charging polarity of toners are applied to primary transfer rollers T1*y*, T1*m*, T1*c*, and T1*k*, which are arranged on the reverse side of the intermediate transfer belt B, at a predetermined timing from a power circuit E controlled by a control unit C.

The toner images on the respective image carriers PRy to PRk are primarily transferred to intermediate transfer belt B by primary transfer rollers T1*y*, T1*m*, T1*c*, and T1*k*. The residual toners on the surfaces of the image carriers PRy, PRm, PRc, and PRk after the primary transfer are cleaned by the image carrier cleaners CLy, CLm, CLc, and CLk as examples of image carrier cleaners.

A belt module BM as an example of an intermediate transfer device that is movable up and down and is capable of being pulled out forward is arranged above the image carriers PRy to PRk. The belt module BM has the intermediate transfer belt B, a tension roller Rt as an example of a tensioning member, a walking roller Rw as an example of a meandering preventing member, an idler roller Rf as an example of a driven member, a back-up roller T2*a* as an example of a secondary transfer facing member serving also as a driving roller as an example of a driving member, and the primary transfer rollers T1*y*, T1*m*, T1*c* and T1*k*. A belt back-up roller Rt+Rw+Rf+T2 as an example of an intermediate transfer body supporting member is constituted by the tension roller Rt, the walking roller Rw, the idler roller Rf, and the back-up roller T2*a* serving also as a driving roller. The intermediate transfer belt B is supported so as to be rotatable and movable by the belt back-up roller Rt+Rw+Rf+T2*a*. Accordingly, an intermediate transfer belt drive unit is constituted by a drive unit that rotates the back-up roller T2*a* serving also as a driving roller, the belt back-up roller Rt+Rw+Rf+T2*a*, and the like.

A secondary transfer roller T2*b* as an example of a secondary transfer member is arranged to face the surface of the intermediate transfer belt B that comes into contact with the back-up roller T2*a*, and a secondary transfer device T2 of Example 1 is constituted by the respective rollers T2*a* and T2*b*. Additionally, a secondary transfer region Q4 is formed in a region where the secondary transfer roller T2*b* and the intermediate transfer belt B face each other.

The toner images sequentially superimposed and transferred onto intermediate transfer belt B by the primary transfer rollers T1*y*, T1*m*, T1*c*, and T1*k* in the primary transfer regions Q3*y*, Q3*m*, Q3*c*, and Q3*k* are transported to the secondary transfer region Q4.

A transfer device T1*y* to T1*k*+T2+B of Example 1 is constituted by the primary transfer rollers T1*y*, T1*m*, T1*c*, and T1*k*, the intermediate transfer belt B, and the secondary transfer device T2.

Three guide rails GR and GR as an example of a pair of right and left guide parts that support sheet feed trays TR1 to TR3 as an example of a medium feed part so as to be capable of entering and leaving back and forth are provided below the latent image forming device ROS. Recording sheets S as an example of a medium are accommodated in the sheet feed trays TR1 to TR3. The recording sheets S are taken out by a pickup roller Rp as an example of a medium take-out member, and are separated one by one by a separation roller Rs as an example of a separation member. A recording sheet S separated by the separation roller Rs is sent to a registration roller Rr as an example of a medium transport timing adjusting member by sheet transport rollers Ra as an example of plural transport members. Plural sheet transport rollers Ra are provided along a transport path SH formed by a medium guide member, a so-called sheet guide, and a registration roller Rr is arranged on the upstream side in the sheet transport direction of the secondary transfer region Q4. A sheet transport device SH+Ra+Rr is constituted by the transport path SH, the sheet transport rollers Ra, the registration roller Rr, and the like.

The registration roller Rr transports the recording sheet S to the secondary transfer region Q4 in accordance with the timing when the toner images formed on the intermediate transfer belt B are transported to the secondary transfer region Q4. When the recording sheet S passes through the secondary transfer region Q4, the back-up roller T2*a* is grounded, namely, earthed and secondary transfer voltages with polarity opposite to the charging polarity of the toners is applied to the secondary transfer roller T2*b* at a predetermined timing from the power circuit E controlled by the control unit C. At this time, the toner images on the intermediate transfer belt B are transferred to the recording sheet S by the secondary transfer device T2.

The intermediate transfer belt B after the secondary transfer is cleaned by a belt cleaner CLb as an example of an intermediate transfer body cleaner.

The recording sheet S to which the toner images are secondarily transferred is transported to a fixing device F. The fixing device F has a heating roller Fh as an example of a heating and fixing member and a pressurizing roller Fp as an example of a pressurizing and fixing member, and when passing through the fixing region Q5 that is a pressure contact region between the heating roller Fh and the pressurizing roller Fp, unfixed toner images of the surface of the recording sheet S are heated and fixed. The recording sheet S on which the toner images are heated and fixed is ejected to a sheet ejection tray TRh as an example of a medium ejection part by an ejection roller Rh as an example of a medium ejection member.

In addition, a mold release agent for improving the mold releasing performance of the recording sheet S from the heating roller Fh is applied to the surface of the heating roller Fh by a mold release agent applicator Fa.

Toner cartridges Ky, Km, Kc, and Kk as an example of a developer replenishing containers that store respective Y, M, C, and K developers are arranged above the belt module BM. The developer contained in the respective toner cartridges Ky, Km, Kc, and Kk are replenished to the respective developing devices Gy, Gm, Gc, and Gk from developer replenishing channels (not shown) in response to consumption of the developer of the developing devices Gy, Gm, Gc, and Gk.

In FIG. 1, the image forming apparatus U has an upper frame body UF and a lower frame body LF, and the latent image forming device ROS, and the image carriers PRy, PRm, PRc, and PRk, the developing devices Gy, Gm, Gc, Gk, the belt module BM, and the like that are arranged above the latent image forming device ROS are supported on the upper frame body UF.

Additionally, the guide rail GR that supports the sheet feed trays TR1 to TR3, and the pickup roller Rp, the separation roller Rs, the sheet transport rollers Ra, and the like that perform sheet feeding from the respective sheet feed trays TR1 to TR3 are supported on the lower frame body LF.

(Developing Device)

Figure 3:
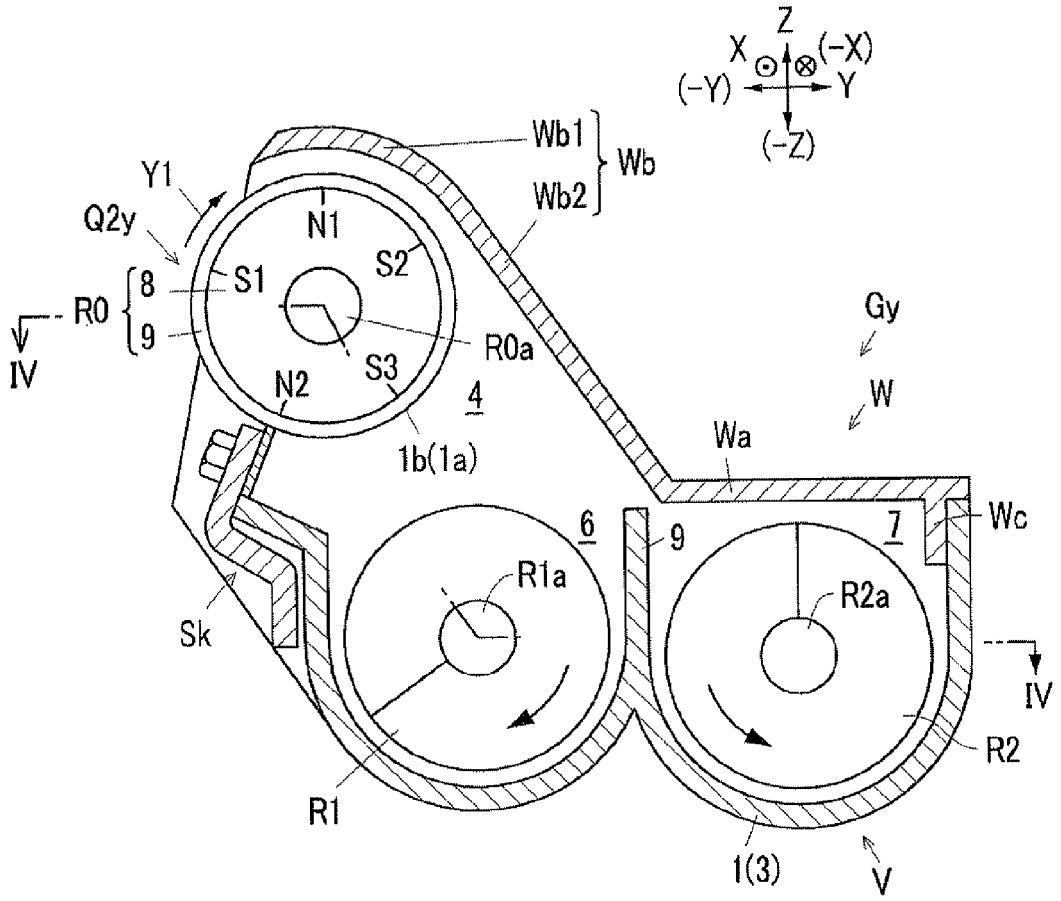
FIG. 3 is an explanatory view of a developing device of Example 1 of the invention.

FIG. 3 is an explanatory view of the developing device of Example 1 of the invention.

Figure 4:
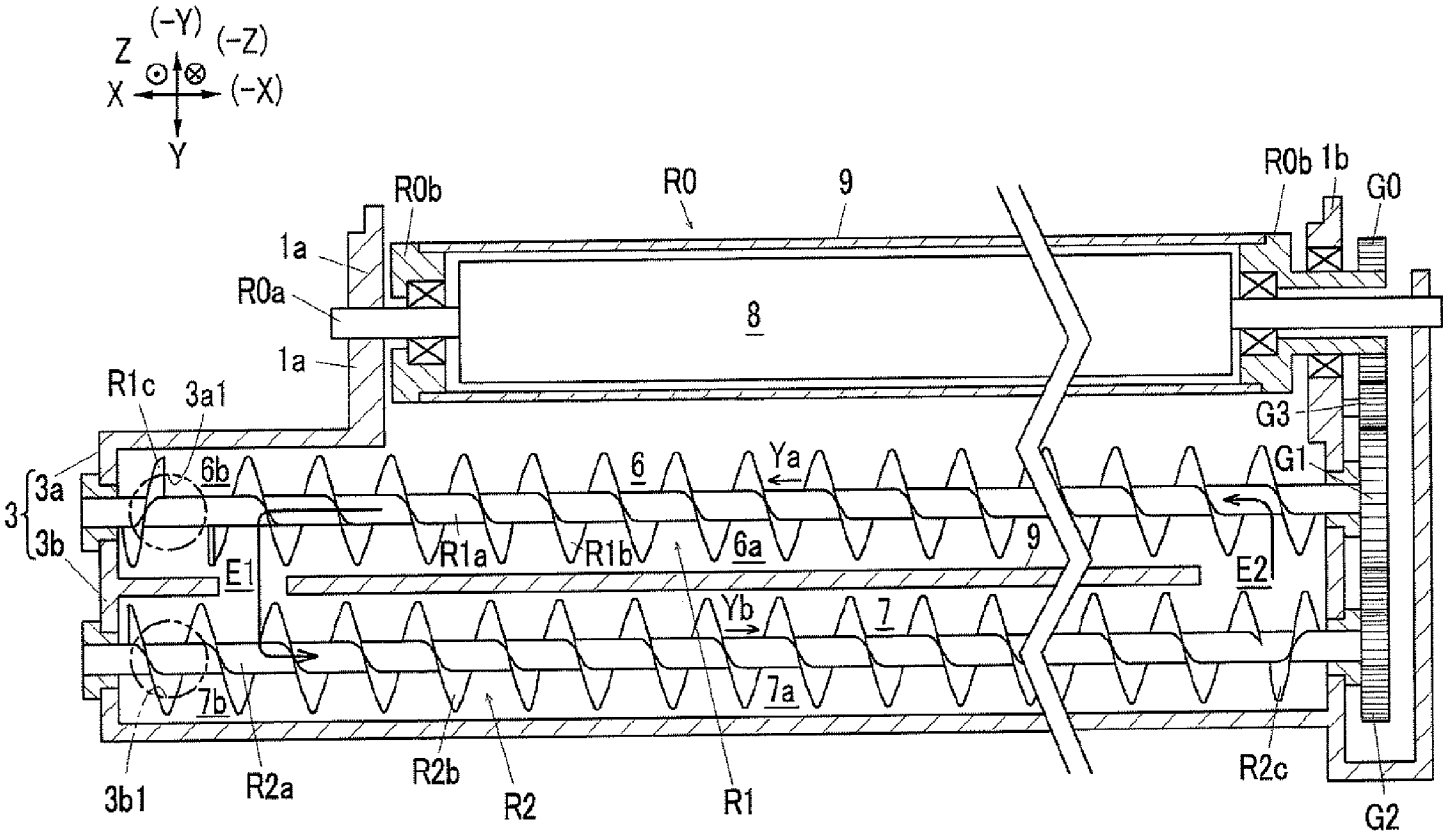
FIG. 4 is a front cross-sectional explanatory view of the developing device of Example 1 of the invention, and is a cross-sectional view taken along the line IV-IV of FIG. 3.

FIG. 4 is a front cross-sectional explanatory view of the developing device of Example 1 of the invention, and is a cross-sectional view taken along the line IV-IV of FIG. 3.

In addition, since the developing devices Gy, Gm, Gc, and Gk have the same configuration, the developing device Gy will be described below, and description of the other developing devices Gm, Gc, and Gk will be omitted.

In FIGS. 3 and 4, the developing device Gy that is arranged to face the image carrier PRy in the developing region Qty has a developer container V that stores a developer including a toner and a carrier. The developer of Example 1 is constituted by a two-component developer including a toner charged with negative polarity, and a magnetic carrier charged with positive polarity. In addition, in Example 1, a two-component developer in which the average particle diameter of a toner is 5.8 [μm] and the average particle diameter of a carrier is 35 [μm] is used as an example.

The developer container V has a developer container body 1, and a developer container cover W as an example of a lid member that covers an upper end of the body. A front-side connecting member 3 that protrudes forward as shown in FIG. 4 is formed integrally with a front end of the developer container body 1. Both ends of a layer thickness regulating member SK that extends in the longitudinal direction of the developing device Gy are fixed to a front wall 1*a* and a rear wall 1*b* of the developer container body 1 with screws.

In FIG. 3, the developer container body 1 has therein a developing roller chamber 4 as an example of an accommodating chamber of a developer holder where a developing roller R0 as an example of a developer holder is accommodated, a first stirring chamber 6 adjacent to the developing roller chamber 4, and a second stirring chamber 7 adjacent to the first stirring chamber 6. The developer container cover W has an upper wall Wa arranged on the second stirring chamber 7, a developer holder accommodating wall Wb that extends from a left end portion of the upper wall Wa, and forms the developing roller chamber 4, and a fitting portion We that extends downward from a right portion of the upper wall Wa and fits to the inner wall of the developer container body 1. The developer holder accommodating wall Wb has an arcuate top wall Wb1 and a plate-like inclination wall Wb2.

In FIG. 4, the first stirring chamber 6 has a first main stirring chamber 6*a* on the developer container body 1 side, and a discharge chamber 6*b* on a left portion 3*a* side of the front-side connecting member 3. Additionally, the second stirring chamber 7 has a second main stirring chamber 7*a* on the developer container body 1 side, and a replenishing chamber 7*b* on a right portion 3*b* side of the front-side connecting member 3. Portions other than both ends of the first main stirring chamber 6*a* and the second main stirring chamber 7*a* are partitioned by a partition wall 9 between the first stirring chamber 6 and the second stirring chamber 7 inside the developer container body 1. That is, the first main stirring chamber 6*a* and the second main stirring chamber 7*a* are configured such that a developer is able to flow into the chambers at a front-side inflow portion E1 and a rear-side inflow portion E2 of both ends of the chambers in the front-and-rear direction.

A circulation stirring chamber 6+7 of Example 1 is constituted by the first stirring chamber 6 and the second stirring chamber 7.

In FIGS. 3 and 4, a developer discharge port 3*a*1 is provided at a lower portion of the left portion 3*a* of a front-side connecting member 3, and as shown in FIG. 4, a replenishing port 3*b*1 is provided in an upper portion of the right portion 3*b* of the front-side connecting member 3. The replenishing port 3*b*1 is arranged on the downstream side in a developer transport direction of the discharge port 3*a*1 such that a replenished new developer is not discharged immediately after replenishment. Additionally, in Example 1, a developer, a so-called high-concentration toner, which includes toner consumed by development and a carrier that deteriorates and is discharged little by little from the discharge port 3*a*1 and that has a higher toner ratio than the ratio of a toner within the developer container V, is supplied from the replenishing port 3*b*1. Accordingly, in the developing devices Gy to Gk of Example 1, the carrier that has deteriorated with image formation operation is discharged from the developer discharge port 3*a*1, and is replenished with the high-concentration toner including a new carrier, whereby the carrier is exchanged little by little.

(Developing Roller)

In FIGS. 3 and 4, the developing roller R0 has a magnet roller 8 that is fixed to and supported on the developer container V as an example of a magnet member, and a cylindrical developing sleeve 9 that is rotatably supported at the outer periphery of the magnet roller 8 and is rotated in the direction of an arrow Y1 that is the direction opposite to gravity in the developing region Q2*y*, as an example of a developer holder body.

The magnet roller 8 has a developing magnetic pole S1 that is arranged to face the image carrier PRy, a layer-thickness-regulating magnetic pole N2 that is arranged on the upstream side of the developing magnetic pole S1 in the rotational direction of the developing sleeve 9 and is arranged to face the layer thickness regulating member SK, a transporting magnetic pole N1 that is arranged on the downstream side of the developing magnetic pole S1 in the rotational direction of the developing sleeve 9, a pickoff magnetic pole S2 as an example of a developer peeling-off magnetic pole that is arranged on the downstream side of the transporting magnetic pole N1 in the rotational direction of the developing sleeve 9, and a pickup magnetic pole 53 as an example of a developer attracting magnetic pole that is arranged between the pickoff magnetic pole S2 and the layer-thickness-regulating magnetic pole N2.

Figure 5A:
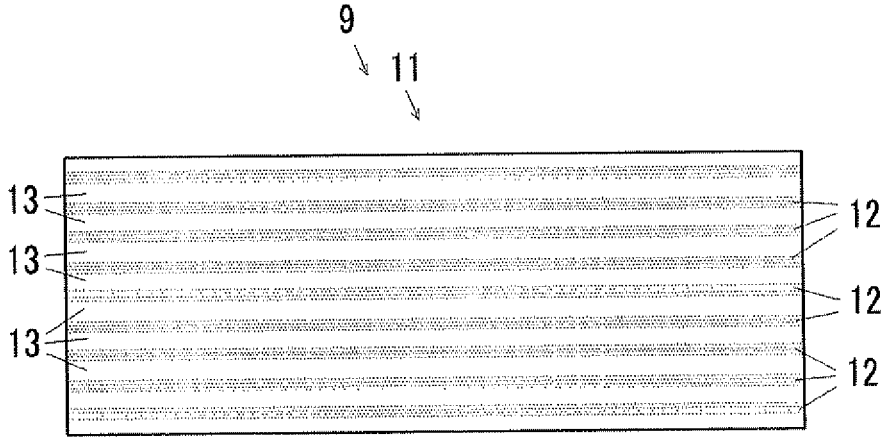
FIGS. 5A and 5B are explanatory views of a developing sleeve of Example 1 of the invention.
Figure 5B:
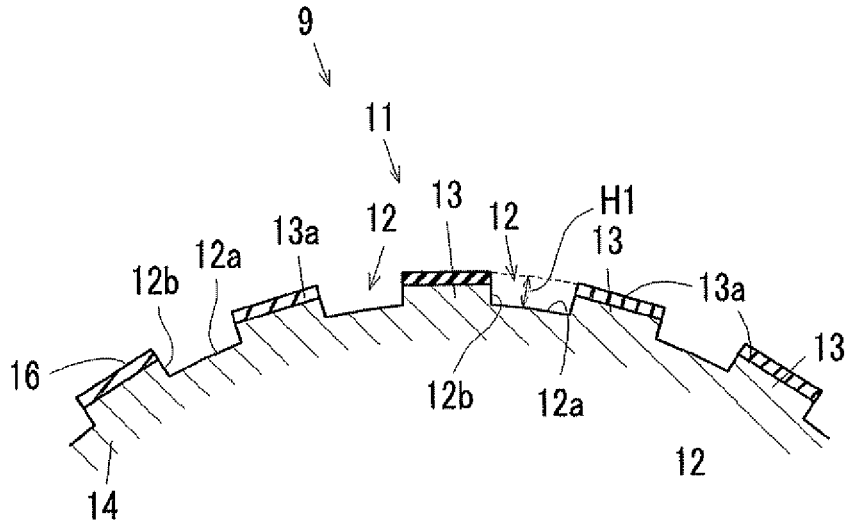

FIGS. 5A and 5B are explanatory views of the developing sleeve of Example 1 of the invention, FIG. 5A is an explanatory view of chief parts of the outer surface of the developing sleeve, and FIG. 5B is a cross-sectional view of chief parts of the developing sleeve.

In FIGS. 5A and 5B, a concave-convex portion 11 is formed in the outer surface of the developing sleeve 9. The concavo-convex portion 11 of Example 1 has concave groove portions 12 that extend in the axial direction of the developing sleeve 9 as an example of concave portions. Plural groove portions 12 are formed at preset intervals in the circumferential direction of the developing sleeve 9. A convex portion 13 of Example 1 is formed by the portion between the groove portion 12 and the groove portion 12.

In FIG. 5B, the difference between a radial outer end 13*a* of the convex portion 13 and a radial inner end 12*a* of the groove portion 12, i.e., the depth H1 of the groove portion 12 has a preset depth. In addition, in Example 1, H1=100 [μm] is set as an example of the preset depth. A developer may be stored in the groove portion 12, and when the developer is held on the developing sleeve 9, plural carriers are stored with toner. In addition, although H1=100 [μm] is illustrated as a setting value of the depth H1, as the setting value of the depth H1, a value that is equal to or more than the average particle diameter of carrier grains may be set, and a value that is equal to or more than 35 [μm] may be set.

In FIG. 5B, in Example 1, the radial inside of the developing sleeve 9 is made of a conductor, the portion of the radial outer end 13*a* of the convex portion 13 in the developing sleeve 9 is made of a laminated insulator. Thereby, the concavo-convex portion 11 of the developing sleeve 9, as shown in FIG. 5B, is composed of a conductive layer 14 of the radial inside, and an insulating layer 16 of the radial outer end 13*a* of the convex portion 13. A bottom face 12*a* equivalent to the radial inner end 12*a* of the groove portion 12 and a lateral face 12*b* of the groove portion 12 have conductivity, and an outer peripheral surface 13*a* equivalent to the radial outer end 13*a* of the convex portion 13 has insulation. Accordingly, in the concavo-convex portion 11 of the developing sleeve 9, the volume resistivity of the portion corresponding to the convex portion 13 is set to be larger than the volume resistivity of the portion corresponding to the groove portion 12. Even if charge is injected into a developer held by the conductive layer 14 of the developing sleeve 9, it is difficult for charge to flow to the outer peripheral surface 13*a*, which is the portion of the radial outer end of the developing sleeve 9, in the radial direction. Therefore, charge is not easily injected into the developer.

In addition, in Example 1, the volume resistivity of a carrier is set to be larger than the volume resistivity of the conductor of the conductive layer 14, and the volume resistivity of the insulating layer 13*a* is larger than at least the volume resistivity of the carrier, and the insulating layer preferably has insulation.

Figure 6:
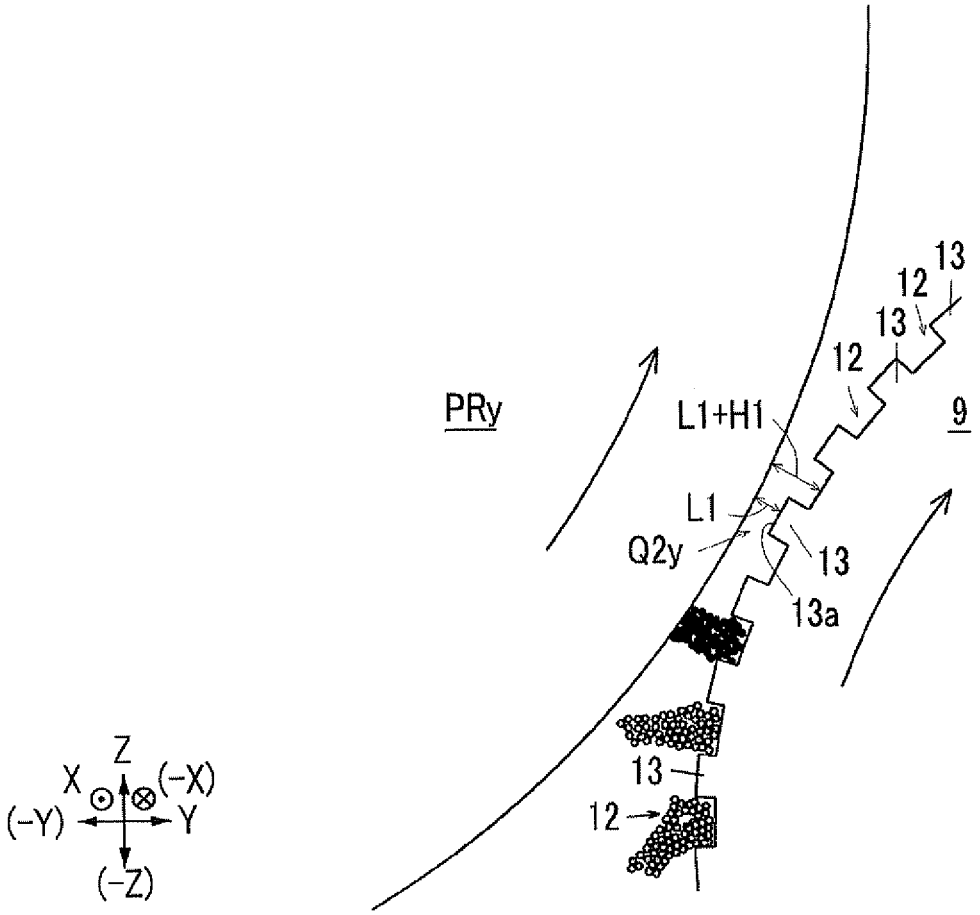
FIG. 6 is an explanatory view of an image carrier and a developing roller, and is an enlarged view of chief parts of FIG. 3.

FIG. 6 is an explanatory view of an image carrier and a developing roller, and is an enlarged view of chief parts of FIG. 3.

In FIG. 6, the developing roller Ra is arranged at preset spacing from the image carrier PR in the developing region Q2*y*. In Example 1, the spacing when the image carrier PRy is brought closest to the developing sleeve 9, that is, the spacing L1 between the radial outer end 13*a* when the radial outer end 13*a* of the convex portion 13 passes through the developing region Q2*y*, and the surface of the image carrier PRy becomes 200 [μm]. In addition, the spacing L1 is not limited to 200 [μm], and may be set to 200 [μm] to 350 [μm] according to the configuration of the visible image forming device Uy.

In FIGS. 3 and 6, in the developing device Gy, the developer of the first main stirring chamber 6*a* is attracted to the surface of the developing sleeve 9 by the pickup magnetic pole S3, and is transported to the developing region Q2 in a state where layer thickness is regulated by the layer-thickness-regulating magnetic pole N2 and the layer thickness regulating member SK. In this case, the developer held by the outer peripheral surface 13*a* of the convex portion 13 is apt to slide on the outer peripheral surface 13*a* that rotates, whereas the developer held by the groove portion 12 is apt to contact the lateral face 12*a* of the groove portion 12 and be rotated together with the developing sleeve 9 without sliding and being transported.

In FIG. 4, an outer peripheral shaft R0*b* that supports the developing sleeve 9 is rotatably supported corresponding to the front and rear of the developing sleeve 9 on the outer peripheral side of a roller shaft R0*a* of the developing roller R0, and as shown in FIG. 4, a gear G0 as an example of a driving transmission member is fixed to and supported on the outer peripheral shaft R0*b* on the rear end side. Accordingly, when the gear G0 rotates, the outer peripheral shaft R0*b* rotates around the roller shaft R0*a*, and the developing sleeve 9 rotates at the outer periphery of the magnet roller 8.

In FIGS. 3 and 4, the first stirring member R1 and the second stirring member R2 that transport a developer while stirring the developer are arranged in the first stirring chamber 6 and the second stirring chamber 7. In FIG. 4, the first stirring member R1 has a first rotating shaft R1*a* that extends in the axial direction of the developing roller R0, and a stirring and transporting blade R1*b* and a reverse transporting blade R1*c* secured to the outer periphery of the rotating shaft R1*a*.

The stirring and transporting blade R1*b* is provided toward the front-side inflow portion E1 from the rear side inflow portion E2 in order to convey a developer in a first transport direction Ya on the front side from the rear side. The reverse transporting blade R1*c* is provided near the discharge port 3*a*1, and transports a developer in a direction opposite to the transport direction of the stirring and transporting blade Rib, thereby causing the developer to flow into the second stirring chamber 7 from the first stirring chamber 6. The rotating shaft R1*a* is rotatably supported by a front surface wall of the left portion 3*a* of the front-side connecting member 3 and a rear surface wall of the developer container body 1, and the gear G1 is fixed to a rear end portion of the rotating shaft R1*a*, that is, an X-side end of FIG. 4.

Additionally, the second stirring member R2 also has a second rotating shaft R2*a*, a stirring and transporting blade R2*b*, and a reverse transporting blade R2*c*. The stirring and transporting blade R2*b* is provided toward the rear-side inflow portion E2 from the replenishing port 3*b*1 in order to convey a developer in a second transport direction Yb on the rear side from the front side. In FIG. 4, the reverse transporting blade R1*c* is provided near the rear end side of the rear side inflow portion E2, and transports a developer in a direction opposite to the transport direction of the stirring and transporting blade R2*b*, thereby causing the developer to flow into the first stirring chamber 6 from the second stirring chamber 7. The second rotating shaft R2*a* is rotatably supported by a front surface wall of the right portion 3*b* of the front-side connecting member 3 and a rear surface wall of the developer container body 1, and the gear G2 is secured to a rear end portion of the second rotating shaft R2*a*.

In FIG. 4, the gear G0 of the roller shaft R0*a* meshes with the gear G1 of the first rotating shaft R1*a* via an intermediate gear G3, and the gear G1 meshes with the gear G2 of the second rotating shaft R2*a*. The rotative force of a motor for a developing device as an example of a developing device drive source (not shown) is transmitted to the gear G0, and when the gear G0 is rotated by the motor, the gear G1 rotates with the same direction as the gear G0, and the gear G1 and the gear G2 rotates in opposite directions to each other. That is, since the gear G1 and the gear G2 rotate integrally, the first stirring member R1 and the second stirring member R2 rotate in opposite directions to each other. Accordingly, the developers in the first stirring chamber 6 and the second stirring chamber 7 are transported and circulated in opposite directions to each other by the rotation of the first stirring member R1 and the second stirring member R2.

The developing device Gy is constituted by the developer container V, the developing roller R0, the first stirring member R1, and the second stirring member R2, and the like.

(Power Circuit)

Figure 7:
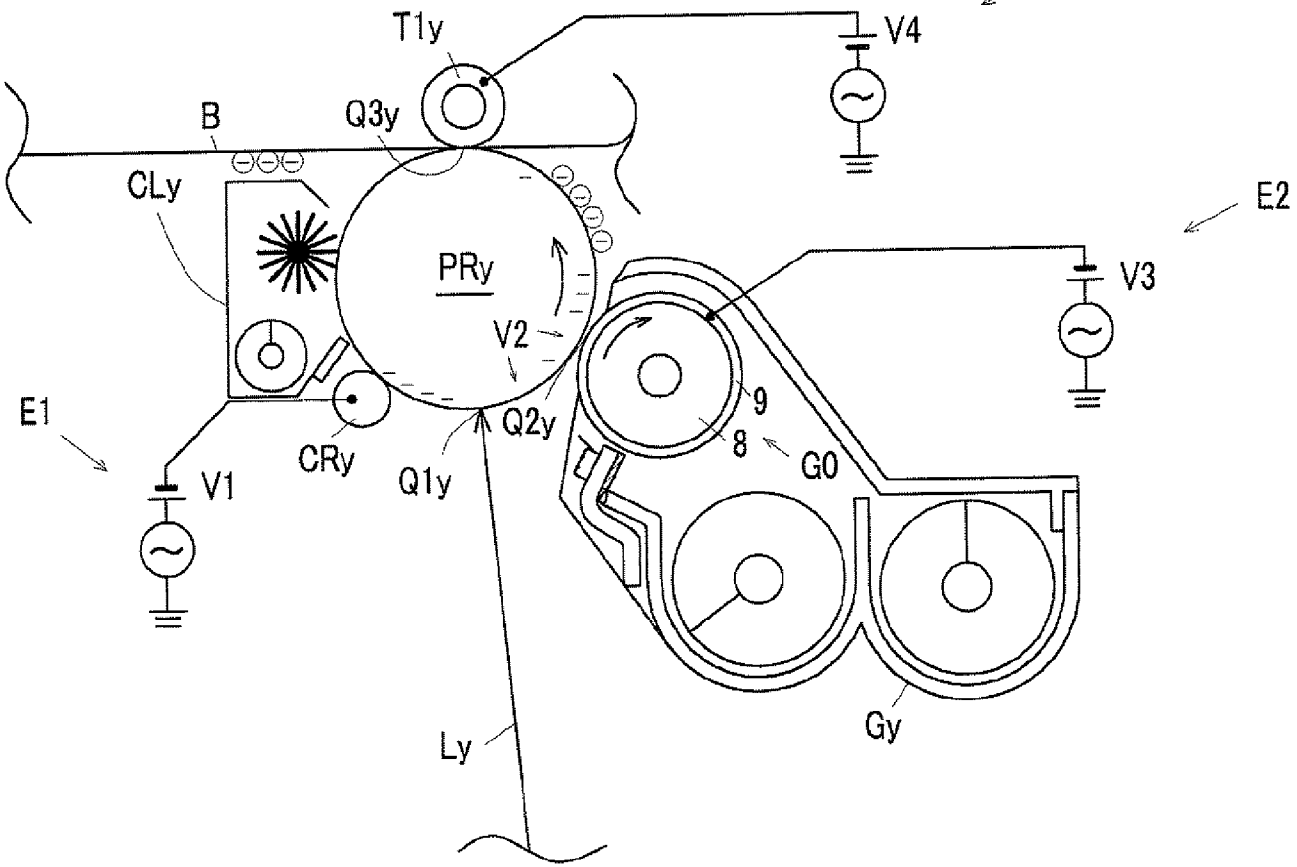
FIG. 7 is an explanatory view of a power circuit connected to a charging roller of Example 1, a power circuit connected to the developing roller, and a power circuit connected to a primary transfer roller.

FIG. 7 is an explanatory view of a power circuit connected to the charging roller of Example 1, a power circuit connected to the developing roller, and a power circuit connected to the primary transfer roller.

Although a power circuit E1 connected to the charging rollers CRy to CRk, a power circuit E2 connected to the developing roller R0, and a power circuit E3 connected to the primary transfer rollers T1*y* to T1*k* are described below, the power circuits E1 to E3 of the respective colors Y to K are similarly configured, only the power circuits E1 to E3 of Y color will be described, and the description of the power circuits E1 to E3 for the other colors M to K will be omitted.

In FIG. 7, the power circuit E1 for charging that applies a charging voltage V1 for charging the surface of the image carrier PRy is connected to the charging roller CRy. The charging roller CRy charges the surface of the image carrier PRy uniformly with a charging potential V1.

In FIG. 7, a laser beam Ly is irradiated on the outer surface of the image carrier PRy charged with the charging potential V1 from the latent image forming device ROS, and an electrostatic latent image of a latent image potential. V2 is formed on the irradiated portion.

The power circuit E2 for development as an example of a voltage application unit is connected to the developing sleeve 9 of the developing roller R0 in the developing device Gy. The power circuit E2 for development applies a developing voltage V3 to the developing sleeve 9, to generate a potential difference V2-V3 between the image carrier PRy and the developing sleeve 9 to form, on the developing region Qty, an electric field by which a toner is directed toward a latent image of the image carrier PRy from the developing sleeve 9.

In addition, the respective voltages V1 to V3 of Examples 1 are set so as to satisfy V1<V3<V2. Accordingly, in Example 1, the potential difference V2-V3 between the latent image of the image carrier PRy and the developing roller R0 becomes positive, while a potential difference V1-V3 between portions other than the latent image of the image carrier PRy, and the developing roller R0 becomes negative. Thereby, a toner that has negative polarity moves toward the latent image of the image carrier PRy from the developing roller R0.

A primary transfer voltage V4 for transferring the toner on the image carrier PRy to the intermediate transfer belt B is applied to the primary transfer roller T1*y*. In addition, a secondary transfer voltage that transfers the toner transferred onto the intermediate transfer belt B to a recording sheet S from a power circuit (not shown) is applied to the secondary transfer device T2.

(Operation of Example 1)

In the copying machine U of Example 1 having the above configuration, when a job as an example of an image formation operation is performed, the charging rollers CRy to CRk charge the image carriers PRy to PRk, and the latent image forming device ROS forms electrostatic latent images on the image carriers PRy to PRk. The electrostatic latent images are developed as toner images by the developing roller R0 of developing devices Gy to Gk in the developing regions Q2*y* to Q2*k*. The toner images are transferred to a recording sheet S via the transfer devices T1*y* to T1*k*+T2+E.

Figure 8:
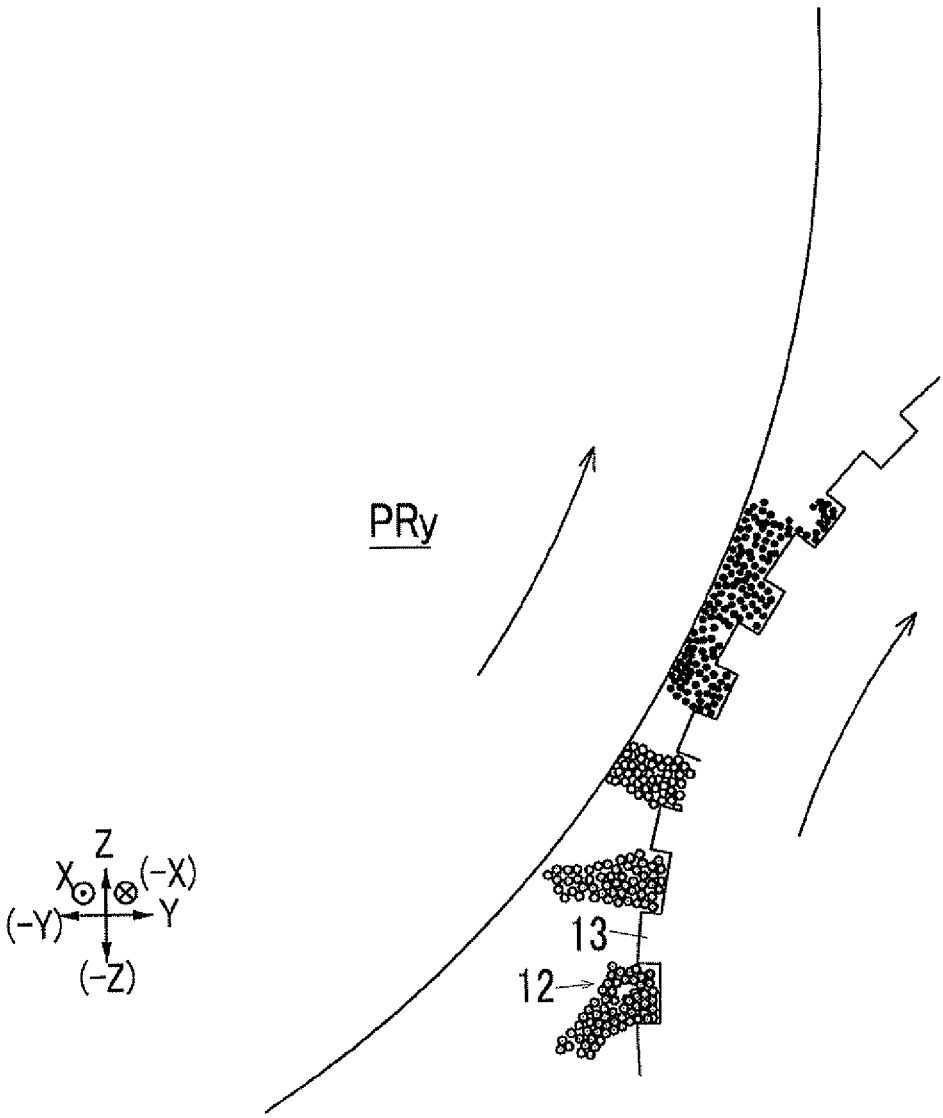
FIG. 8 is an explanatory view of the operation of Example 1 of the invention, and is an enlarged view of a developing region.

FIG. 8 is an explanatory view of the operation of Example 1 of the invention, and is an enlarged view of a developing region.

At this time, in the developing devices Gy to Gk of Example 1, a developer stored in the developer container V receives a magnetic force from the magnet roller 8, and is attracted to and held by the outer surface of the developing sleeve 9 that rotates, and is transported toward the developing regions Q2*y* to Q2*k*.

In FIG. 8, in the developing sleeve 9 of Example 1, a developer that is stored in and held by the groove portion 12 is brought into contact with the lateral face 12*b* and transported together with the developing sleeve 9, with the rotation of the developing sleeve 9, the developer held at the outer peripheral surface 13*a* of the convex portion 13 is apt to slide on the rotating outer peripheral surface 13*a*. Then, when the developer on the developing sleeve 9 approaches the developing regions Q2*y* to Q2*k*, the developer is brought into a napped state along the line of magnetic force of the developing magnetic pole 51. The napped developer comes into contact with and is collapsed by the surfaces of the image carriers PRy to PRk, and fills the space between the image carriers PRy to PRk and the developing sleeve 9, as the spacing between the image carriers PRy to PRk and the developing sleeve 9 becomes narrow. Accordingly, in the developing regions Q2*y* to Q2*k*, the developer is transported in a state where the developer has adhered not only to the groove portion 12 but also to the surface of the convex portion 13.

Additionally, in the developing devices Gy to Gk of Example 1, the developing voltage V3 is applied to the developing sleeve 9, and the potential differences V1-V3 and V2-V3 are generated between the image carriers PRy to PRk and the developing sleeve 9 to form an electric field. Here, as the developing regions Q2*y* to Q2*k* are approached, the spacing between the image carriers PRy to PRk and the developing sleeve 9 becomes narrow, and the electric field between the image carriers PRy to PRk and the developing sleeve 9 becomes strong.

In the developing regions Q2*y* to Q2*k*, toner in a developer that is nonmagnetic and has negative polarity receives a force from a developing electric field on the basis of the potential difference V2-V3 generated between the latent images of the image carriers PRy to PRk and the developing sleeve 9, and moves toward the latent images, and the latent images are developed as toner images.

When the developer is transported to the developing regions Q2*y* to Q2*k*, as shown in FIGS. 5A, 5B and 8, negative electric charge flows to the developer on the developing sleeve from the conductive layer 14, and charge injection is performed on the developer. This charge injection becomes faster as the intensity of an electric field becomes stronger, and a large amount of charge is apt to be injected in a short period of time. Accordingly, as the developing regions Q2*y* to Q2*k* are approached, prolonged charge injection is performed on the developer on the developing sleeve 9, and charge injection is performed in a strong electric field, and thereby a larger amount of negative electric charge is apt to be injected.

When a large amount of negative electric charge is injected into a developer, a carrier charged with positive polarity as well as toner will have large negative polarity, will receive a force from an electric field similarly to toner and move onto the image carriers PRy to PRk. As result, a so-called BCO (Bead Carry Over) may occur and the quality of an image on a recording sheet S may deteriorate.

Additionally, the concavo-convex portion 11 is provided in the outer surface of the developing sleeve 9 of Example 1, and the spacing between the developing sleeve 9 and the image carriers PRy to PRk in the developing regions Q2*y* to Q2*k* differs in the groove portion 12 and the convex portion 13. That is, the spacing between the outer surfaces of the image carriers PRy to PRk and the developing sleeve 9 is L1+H1 when the groove portion 12 passes through the developing regions Q2*y* to Q2*k*, whereas the spacing between the outer surfaces of the image carriers PRy to PRk and the developing sleeve 9 becomes narrow, by H1 and becomes L1, compared to the spacing in the case of the groove portion 12 when the convex portion 13 passes through the developing regions Q2*y* to Q2*k*.

Accordingly, in the developing sleeve having the concavo-convex portion, as for the magnitude of an electric field produced in the developing regions Q2*y* to Q2*k*, the electric field between an image carrier and a convex portion becomes larger than the electric field between an image carrier and a concave portion. Hence, in the developing sleeve having the concavo-convex portion, compared to a developer held on the concave portion, a larger amount of charger injection is performed on a developer held on the convex portion, and ECO is apt to occur in this developer. Particularly, as the spacing L1 between the image carriers PRy to PRk and the developing sleeve 9 is smaller, a difference in the magnitude of electric fields between a concave portion and a convex portion is apt to become noticeable.

That is, when the volume resistivity of a portion corresponding to a convex portion is not configured so as to be larger than the volume resistivity of a portion corresponding to a concave portion as in the related art, and when charge flows through the developing sleeve, the charge is apt to be injected into a developer on the convex portion from the convex portion. Thus, there is a case where excessive charge injection is performed under a strong electric field when passing through a developing region.

In contrast, in Example 1, the insulating layer 16 is provided on the outer peripheral surface 13*a* of the convex portion 13, and the volume resistivity of the portion corresponding to the convex portion 13 is made larger than the volume resistivity of the portion corresponding to the groove portion 12. Accordingly, in the developing sleeve 9 of Example 1, charge flows in the conductive layer 14 with small volume resistivity and charge injection is performed on the developer on the groove portions 12, whereas charge is intercepted in the insulating layer 16 with large volume resistivity, and the charge is not easily injected into the developer on the outer peripheral surface 13*a* of the convex portion 13 from the inside of the convex portion 13.

That is, in the developing sleeve 9 of Example 1, the charge injection is not easily performed on the developer on the convex portion 13. As a result, when passing the developing regions Qty to Q2*k*, the spacing is narrow, and excessive charge injection into the carrier particularly under a strong electric field is reduced. Accordingly, in Example 1, compared with the related-art configuration, excessive charge injection in the convex portion 13 is reduced, and movement of the carrier to the image carriers PRy to PRk is reduced.

Example 2

Figure 9:
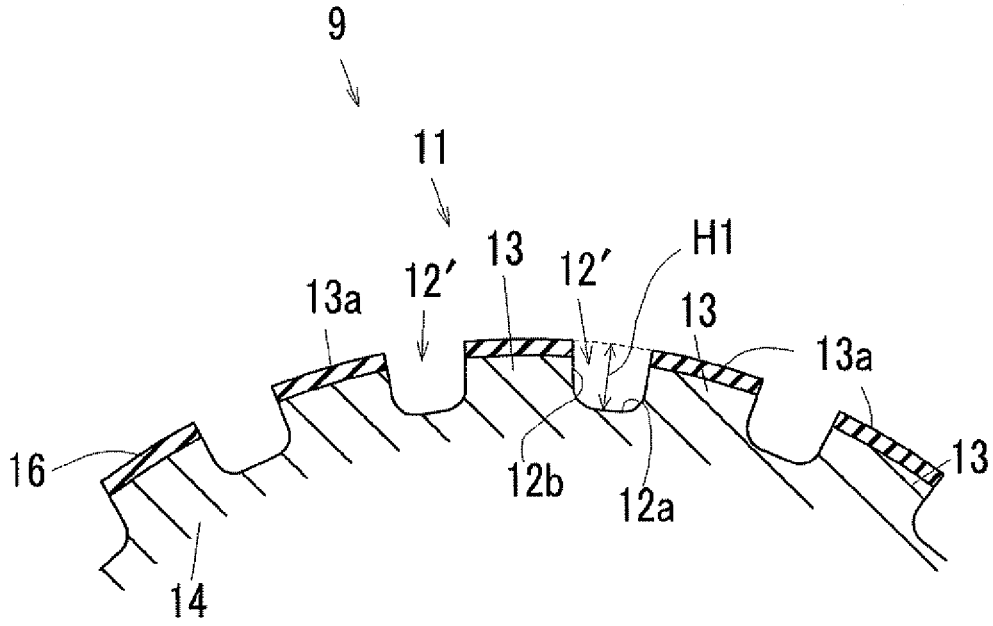
FIG. 9 is a cross-sectional view of chief parts of a developing sleeve of Example 2 of the invention, and is a view corresponding to FIG. 5B of Example 1.

FIG. 9 is a cross-sectional view of chief parts of a developing sleeve of Example 2 of the invention, and is a view corresponding to FIG. 5B of Example 1.

Next, although Example 2 of the invention will be described, in the description of this Example 2, the same reference numerals will be given to constituent elements corresponding to the constituent elements of Example 1, and the detailed description thereof will be omitted.

Although this Example 2 is different from Example 1 in respect of the following points, Example 2 is configured similarly to Example 1 in others points.

In FIG. 9, the developing sleeve 9 of Example 2 is formed with U grooves 12' configured to have a U-shaped cross-section, as an example of concave portions, instead of the groove portions 12 of Example 1.

(Operation of Example 2)

The copying machine U of Example 2 having the above configuration is configured similarly to Example 1 except that the developing sleeve 9 is formed with the U groove 12' having a U-shaped cross-section. Accordingly, also in Example 2, similarly to Example 1, compared with the related-art configuration, excessive charge injection in the convex portion 13' is reduced, and movement of the carrier to the image carriers PRy to PRk is reduced.

Example 3

Figure 10:
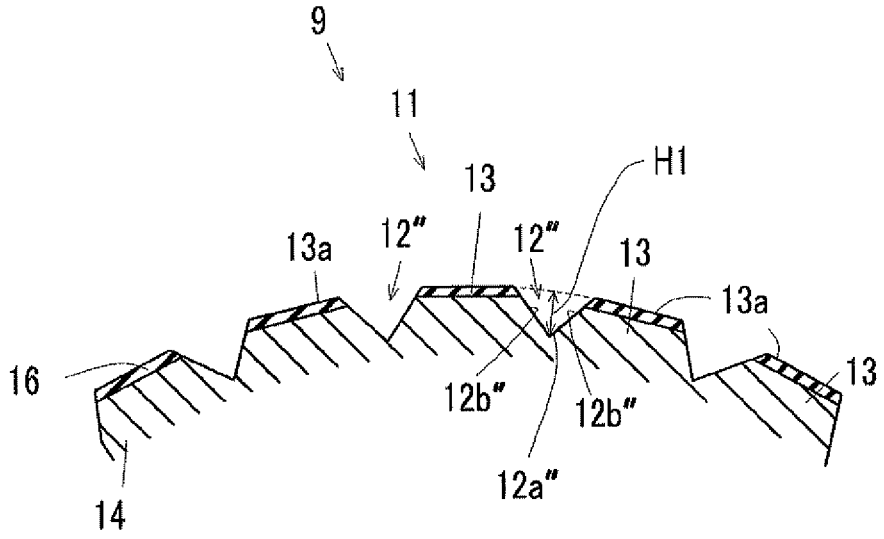
FIG. 10 is a cross-sectional view of chief parts of a developing sleeve of Example 3 of the invention, and is a view corresponding to FIG. 5B of Example 1.

FIG. 10 is a cross-sectional view of chief parts of a developing sleeve of Example 3 of the invention, and is a view corresponding to FIG. 5B of Example 1.

Next, although Example 3 of the invention will be described, in the description of this Example 3, the same reference numerals will be given to constituent elements corresponding to the constituent elements of Example 1, and the detailed description thereof will be omitted.

Although this Example 3 is different from Example 1 in respect of the following points, Example 3 is configured similarly to Example 1 in others points.

In FIG. 10, the developing sleeve 9 of Example 3 is formed with V grooves 12" configured to have a V-shaped cross-section, as an example of concave portion, instead of the groove portions 12 of Example 1. In the V grooves 12", both lateral faces 12*b"* that incline in the direction of a cross-section cross each other at a radial inner end 12*a"*.

(Operation of Example 3)

The copying machine U of Example 3 having the above configuration is configured similarly to Example 1 except that the developing sleeve 9 is formed with the V groove 12" having a V-shaped cross-section. Accordingly, also in Example 3, similarly to Example 1, compared with the related-art configuration, excessive charge injection to the carrier in the convex portion 13 is reduced, and movement of the carrier to the image carriers PRy to PRk is reduced.

Example 4

Figure 11:
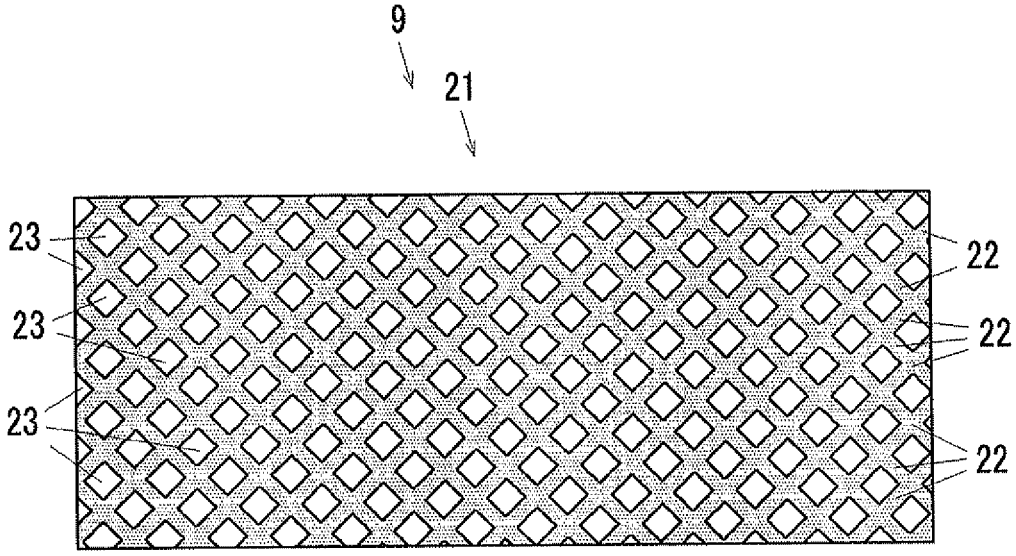
FIG. 11 is an explanatory view of chief parts of the outer surface of a developing sleeve of Example 4 of the invention, and is a view corresponding to FIG. 5A of Example 1.

FIG. 11 is an explanatory view of chief parts of the outer surface of a developing sleeve of Example 4 of the invention, and is a view corresponding to FIG. 5A of Example 1.

Next, although Example 4 of the invention will be described, in the description of this Example 4, the same reference numerals will be given to constituent elements corresponding to the constituent elements of Example 1, and the detailed description thereof will be omitted.

Although this Example 4 is different from Example 1 in respect of the following points, Example 4 is configured similarly to Example 1 in others points.

In FIG. 11, instead of the concavo-convex portion 11 of Example 1, a concavo-convex portion 21 is formed in the outer surface of the developing sleeve 9 of Example 4. The concavo-convex portion 21 of Example 4 has concave groove portions 22 that cross each other obliquely with respect to in the axial direction of the developing sleeve 9 as an example of concave portions. The groove portion 22 is formed in the shape of a so-called twill line. A convex portion 23 of Example 4 is formed by the portion between the groove portion 22 and the groove portion 22.

(Operation of Example 4)

The copying machine U of Example 4 having the above configuration is configured similarly to Example 1 except that the developing sleeve 9 is formed with the twill line-like groove portions 22. Accordingly, also in Example 4, similarly to Example 1, compared with the related-art configuration, excessive charge injection to the carrier in the convex portion 23 is reduced, and movement of the carrier to the image carriers PRy to PRk is reduced.

Example 5

Figure 12:
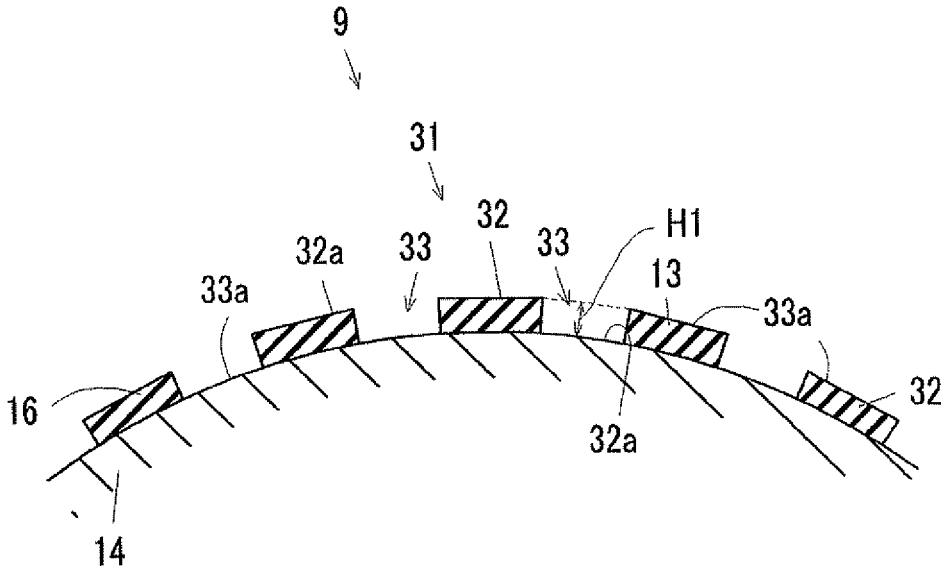
FIG. 12 is a cross-sectional view of chief parts of a developing sleeve of Example 5 of the invention, and is a view corresponding to FIG. 5B of Example 1.

FIG. 12 is a cross-sectional view of chief parts of a developing sleeve of Example 5 of the invention, and is a view corresponding to FIG. 5B of Example 1.

Next, although Example 5 of the invention will be described, in the description of this Example 5, the same reference numerals will be given to constituent elements corresponding to the constituent elements of Example 1, and the detailed description thereof will be omitted.

Although this Example 5 is different from Example 1 in respect of the following points, Example 5 is configured similarly to Example 1 in others points.

In FIG. 12, instead of the concavo-convex portion 11 of Example 1, a concavo-convex portion 31 is formed in the outer surface of the developing sleeve 9 of Example 5. The concavo-convex portion 31 of Example 5 has insulated convex portions 32 made of an insulator, which extend in the axial direction of the developing sleeve 9 as an example of convex portions. Plural insulated convex portions 32 are formed at preset intervals in the circumferential direction of the developing sleeve 9. A concave portion 33 of Example 5 is formed by the portion between the insulated convex portion 32 and the insulated convex portion 32.

(Operation of Example 5)

The copying machine U of Example 5 having the above the configuration is provided with the insulated convex portion 32, and the overall convex portion is made of an insulator. Hence, in the developing sleeve 9 of Example 5, charge does not easily flow to the insulated convex portion 32. Accordingly, also in Example 5, similarly to Example 1, compared with the related-art configuration, excessive charge injection to the carrier in the insulated convex portion 32 is reduced, and movement of the carrier to the image carriers PRy to PRk is reduced.

(Modifications)

Although the Examples of the invention have been described in detail, the invention is not limited to the above Examples, and various modifications can be made thereto within the concept of the invention set forth in the claims. Modifications (H01) to (H04) of the invention are illustrated below.

(H01) Although the copying machine U has been illustrated as an example of the image forming apparatus in the above respective Examples, the invention is not limited thereto, and can be applied to a printer, a facsimile machine, or a multifunction device including these plural functions.

(H02) Although the configuration in which only one insulating layer 16 is provided on the outer peripheral surface 13*a* or 23*a* of the convex portion 13 or 23 is illustrated in the above Examples 1 to 4, the invention is not limited thereto. For example, the configuration in which plural insulating layers 16 are formed on the convex portion 13 or 23, and the convex portion 13 or 23 has multilayer structure may be adopted. Additionally, although it is desirable that the insulating layer 16 constitutes the outer peripheral surface 13*a* or 23*a*, a configuration in which the insulating layer is provided in layers in a radial midway portion of the convex portion 13 may be adopted.

(H03) In the above Examples 1 to 5, it is desirable that the developing sleeve 9 has the configuration that has the conductive layer 14 and the insulating layer 16 of the convex portion 13, 23, or 32. However, the invention is not limited thereto. The volume resistivity of the portion corresponding to the convex portion 13, 23, or 32 may be set to be larger than the volume resistivity of the portion corresponding to the concave portion 12 to 12", 22, or 33. Accordingly, for example, instead of the insulating layer, a configuration of a high resistive layer that has a larger volume resistivity than the conductive layer and a smaller volume resistivity than the insulating layer may be adopted.

(H04) In the above Examples 1 to 4, as for the concavo-convex portions 11, 11', 11", 21 and 31, the configuration formed by the concave portion 12 to 12" and 33 parallel to the axial direction, and the convex portion 13 or 32 pinched by the concave portions 12, 12', 12", and 33, or the configuration formed by the concave portion 22 obliquely formed in the axial direction and the convex portion 23 pinched by the concave portions 22 are illustrated. However, the invention is not limited thereto.

For example, in FIG. 11 of Example 4, a configuration in which plural concave portions are provided in a dotted manner, a scattered manner, or a discrete manner may be provided, such as forming the positions of the concave portion and the convex portion reversely, and providing the convex portion obliquely in the axial direction of the developing sleeve. Additionally, as well as the configuration in which only either the concave portions or the convex portions are provided in a dotted manner, a scattered manner, or a discrete manner, for example, a configuration is possible in which convex and concave portions are irregularly provided in a preset ratio.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a rotating image carrier;

a charging device that charges an outer surface of the image carrier;

a latent image forming device that forms a latent image on the outer surface of the charged image carrier;

a developing device that has a developer container that stores a developer including a toner and a carrier, and a developer holder that holds the developer stored in the developer container on the outer surface and rotates and transports the developer toward a developing region that faces the image carrier, and that develops the latent image of the image carrier as a visible image;

a voltage application unit that applies a voltage to the developer holder, and that generates a potential difference between the image carrier and the developer holder to form an electric field, by which toner is directed toward the latent image of the image carrier from the developer holder, in a developing region; and a transfer device that transfers the visible image of the image carrier to a medium, wherein the developer holder having a convex portion and a concave portion in an outer surface thereof and the volume resistivity of the convex portion is set to be larger than the volume resistivity of the concave portion.

2. The image forming apparatus according to claim 1, wherein the convex portion has an insulating layer including an insulator.

3. The image forming apparatus according to claim 1, wherein the concave portion stores a developer.

4. The image forming apparatus according to claim 2, wherein the concave portion stores a developer.

5. The image forming apparatus according to claim 1, wherein the concave portion has a predetermined depth equal to or greater than an average particle diameter of carrier grains.

6. The image forming apparatus according to claim 1, wherein a radial inside of the developing sleeve is made of a conductor, and a portion of a radial outer end of the convex portion in the developing sleeve is made of a laminated insulator.

* * * * *